US010472024B1

(12) United States Patent
Liollio

(10) Patent No.: US 10,472,024 B1
(45) Date of Patent: Nov. 12, 2019

(54) FLOATING PARKING BARGE FOR VEHICLES

(71) Applicant: Zachary Liollio, Charleston, SC (US)

(72) Inventor: Zachary Liollio, Charleston, SC (US)

(73) Assignee: Zachary Paul Liollio, Charleston, SC (US)

( * ) Notice: Subject to any disclaimer, the term of this patent is extended or adjusted under 35 U.S.C. 154(b) by 0 days.

(21) Appl. No.: 16/040,826

(22) Filed: Jul. 20, 2018

(51) Int. Cl.
*B63B 35/44* (2006.01)
*B63B 35/28* (2006.01)

(52) U.S. Cl.
CPC ..... *B63B 35/28* (2013.01); *B63B 35/44* (2013.01)

(58) Field of Classification Search
CPC ..... B63B 35/28; B63B 15/00; B63B 27/143; B63B 2027/145; E04H 6/44
See application file for complete search history.

(56) References Cited

U.S. PATENT DOCUMENTS

| | | | | |
|---|---|---|---|---|
| 3,964,418 | A * | 6/1976 | Karnik | B63B 35/44 114/70 |
| 9,745,024 | B2 | 8/2017 | Sherwood | |
| 2004/0115006 | A1* | 6/2004 | Facey | B63B 9/04 405/203 |
| 2004/0126205 | A1 | 7/2004 | Amoss, Jr. et al. | |
| 2005/0000398 | A1 | 1/2005 | Mayers | |
| 2016/0281349 | A1* | 9/2016 | Kasanen | E04H 6/44 |

* cited by examiner

*Primary Examiner* — Andrew Polay

(57) ABSTRACT

A floating parking barge includes a floatable hull and a housing. The hull includes a bow end, a stern end, and a support surface extending from the bow end to the stern end. The housing is mounted on the support surface and includes a frame and cladding. The frame includes side supports and top supports, and the cladding is supported on the frame and encloses the frame such that the housing defines a housing space configured to accommodate a plurality of vehicles. The cladding covering the side supports extends at an angle relative to the support surface that is less than 90 degrees.

14 Claims, 4 Drawing Sheets

FLOATING PARKING BARGE FOR VEHICLES

FIELD OF THE INVENTION

This application relates to parking facilities for vehicles, and more particularly to floating parking barges for vehicles.

BACKGROUND

As cities and communities continue to grow, the demand for places to park vehicles continues to increase. Some communities may have enough land to accommodate this demand, but in other communities the ability to meet the demand is much more restricted due to a number of factors such as the location of the communities (e.g., if they are on or near a body of water), if the communities are more established and already built up, etc. Moreover, as the communities grow, the areas where parking is needed may change. Therefore, there is a need for a parking facility that provides increased parking capacity for a particular area and can be moved and positioned as needed or desired. Moreover, there is a need for a facility that may be utilized in various emergency applications where land-based parking is unavailable or unfeasible.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to certain examples, a floating parking barge includes a floatable hull and a housing. The hull includes a bow end, a stern end, and a support surface extending from the bow end to the stern end. The housing is mounted on the support surface and includes a frame and cladding. The frame includes side supports and top supports, and the cladding is supported on the frame and encloses the frame such that the housing defines a housing space configured to accommodate a plurality of vehicles. The cladding covering the side supports extends at an angle relative to the support surface that is less than 90 degrees.

According to various examples, a method of fabricating a parking barge includes pre-assembling a housing by joining side supports of a frame with a base support of the frame and securing cladding to a frame such that the cladding encloses the frame and defines a housing space for the housing. The method also includes providing a hull comprising a bow end, a stern end, and a support surface extending from the bow end to the stern end. The method further includes mounting the housing on the support surface of the hull such that the side supports of the frame and the cladding both extend at an angle less than 90 degrees relative to the support surface.

Various implementations described in the present disclosure can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "forward," "aft," "up," "down," "top," "left," "right," "front," and "back," among others are intended to refer to the orientation as illustrated and described in the figure (or figures) to which the components and directions are referencing.

FIGS. 1-4 illustrate a floating parking barge 100 according to certain aspects of the present disclosure. The parking barge 100 includes a hull 102 and a housing 104 that are floatable on a body of water 116 including, but not limited to, a river, ocean, lake, sea, canal, harbor, etc.

Figure 1:
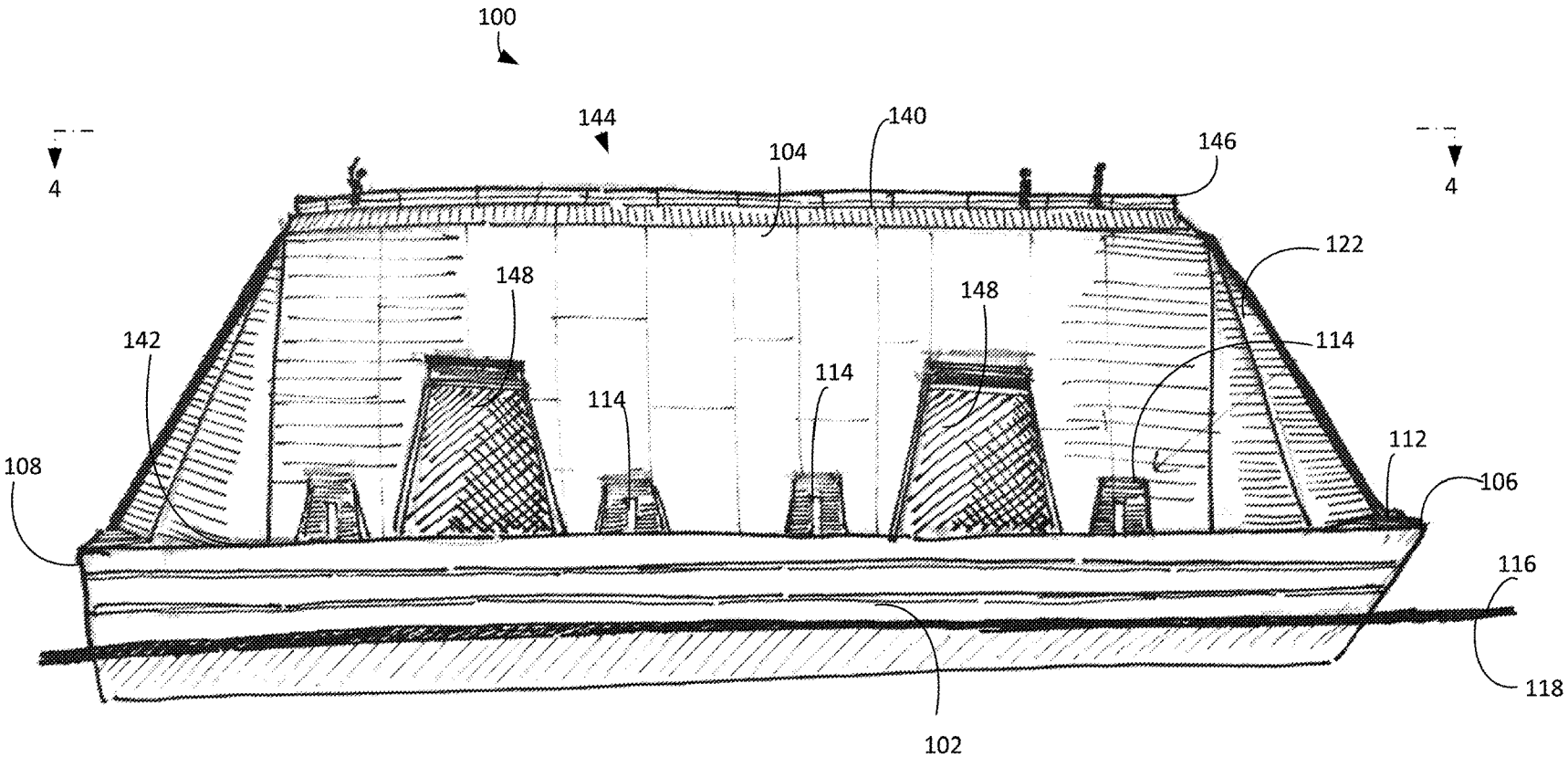
FIG. 1 is a side elevation of an embodiment of a floating parking barge according to aspects of the current disclosure.

In various examples, the hull 102 includes a bow end 106, a stern end 108, and a support surface 110 extending from the bow end 106 to the stern end 108. As illustrated in FIG. 1, in certain cases, the bow end 106 may be shaped to facilitate movement of the parking barge 100 in a particular direction such that it can cut through the water. As some non-limiting examples, the bow end 106 may be a conventional bow, a reverse or wave-piercing bow, a plumb bow, an axe bow, or various other shapes as desired. In other examples, the bow end 106 and stern end 108 may be substantially similar. The hull 102 may include one or more docking locations 112 at which the parking barge 100 may be connected to another vehicle or structure. As one example, a tug boat or other vessel may connect to the parking barge 100 at the docking location 112 to move and position the parking barge 100. In other embodiments, the parking barge 100 can include a motor. In some examples, the hull 102 includes one or more spuds 114 that selectively anchor the parking barge 100 in a desired location on a body of water. In some embodiments, spuds 114 are pipes, pilings, and/or or steel shafts that are driven into the soil at the bottom of the water to impart stability to the parking barge 100 in the water. The number of spuds 114 should not be considered limiting on the current disclosure. Similarly, the location of spuds 114 should not be considered limiting on the current disclosure. As one example, eight spuds 114 may be provided around a perimeter of the hull 102 (four spuds 114 on each side). In other examples, other arrangements and/or numbers of spuds 114 may be utilized. Although spuds 114 are illustrated, in other examples, various other anchoring or mooring mechanisms may be utilized to selectively anchor the parking barge 100 in a desired location including, but not limited to, an anchor weight, cable system, etc.

Figure 2:
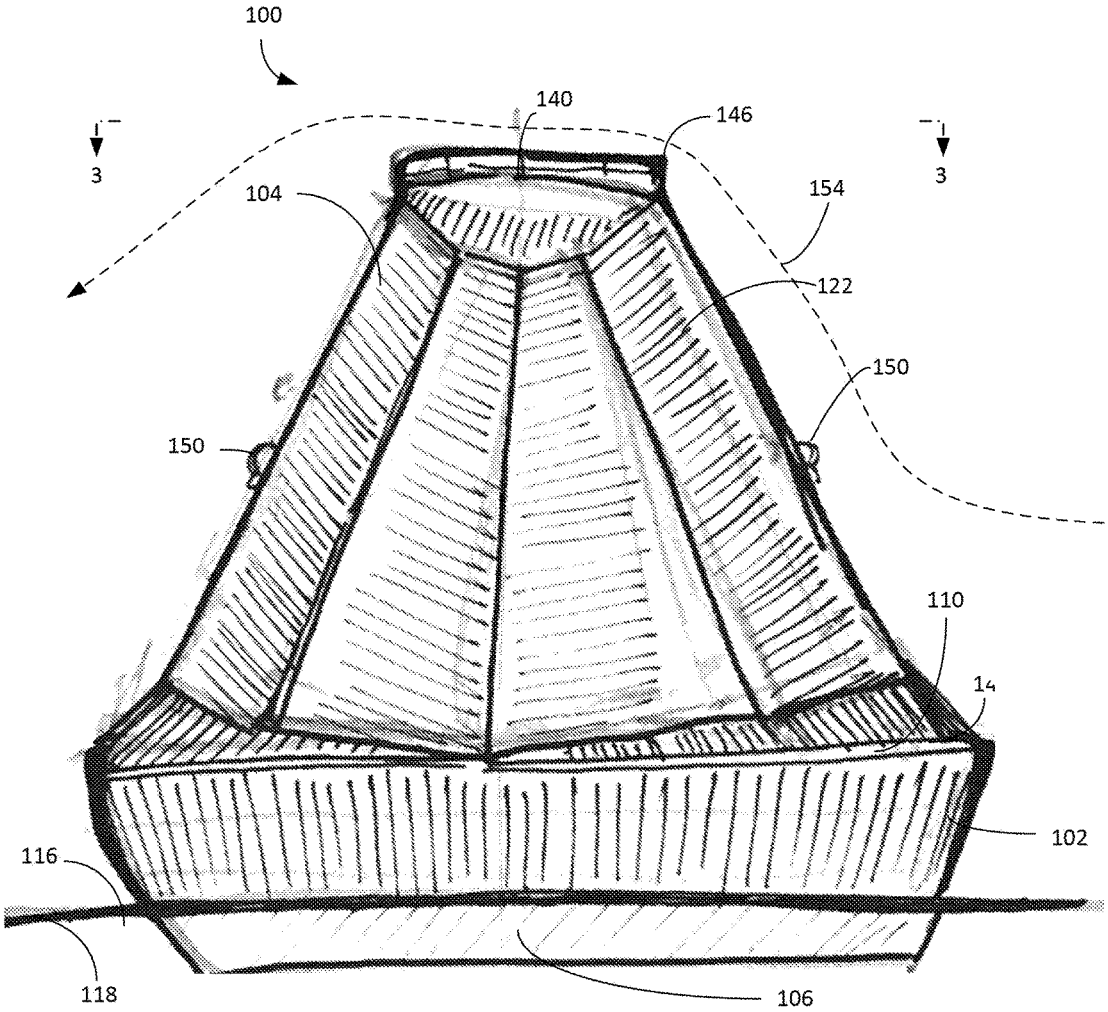
FIG. 2 is an end view of the floating parking barge of FIG. 1.

As illustrated in FIGS. 1 and 2, the housing 104 is mounted on the hull 102 such that the housing 104 is supported above a water line 118 of the body of water 116. The housing 104 includes a frame 120 and cladding 122. In various examples, the housing 104 and hull 102 are modular such that the housing 104 and/or hull 102 may be individually pre-assembled before the housing 104 is joined to the hull 102. In certain aspects, the housing 104 is joined to the hull 102 through mechanical fasteners (including, but not limited to, pins, bolts, hooks, chains, and/or various other suitable mechanical fasteners), welding, various adhesives, and/or various other suitable joining techniques.

Figure 3:
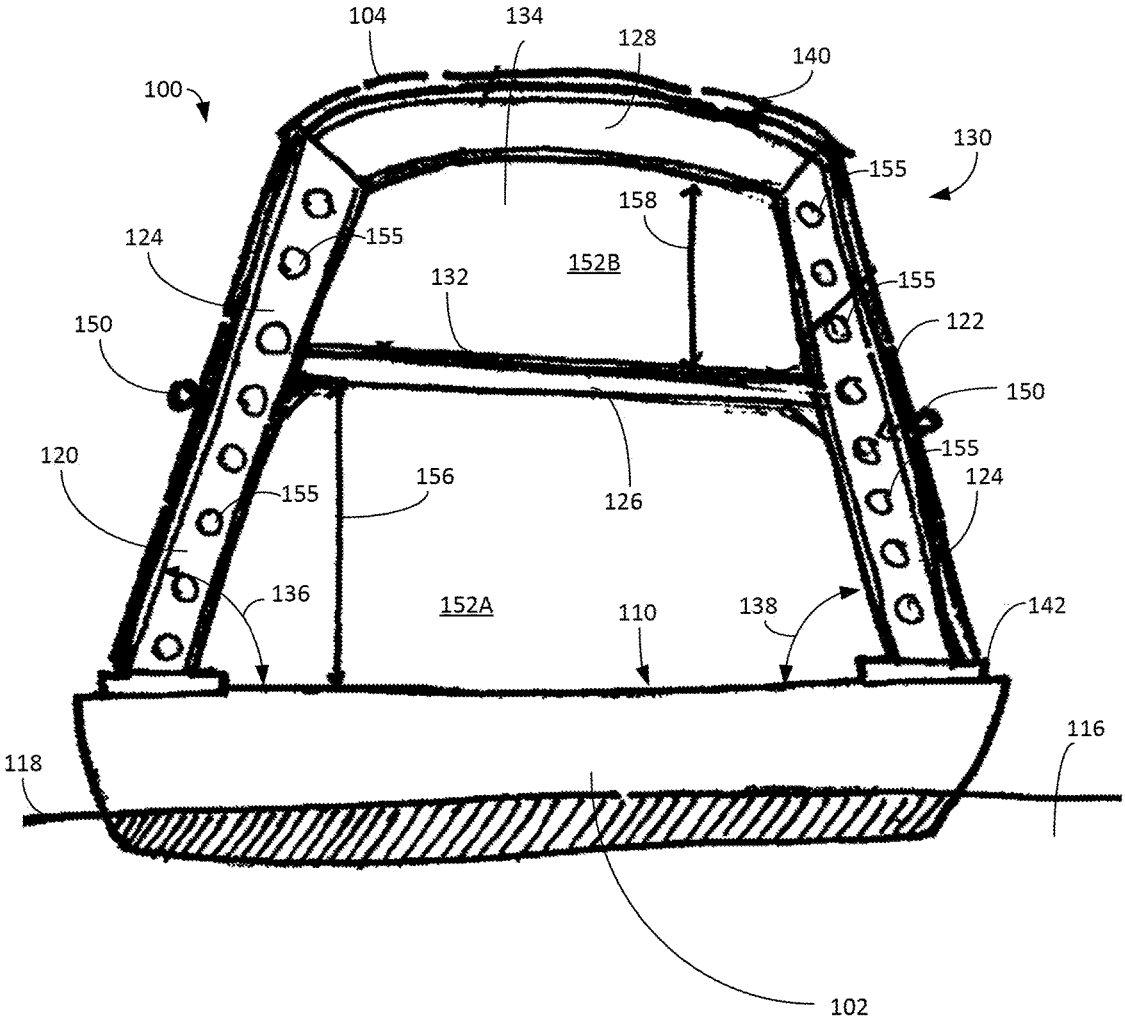
FIG. 3 is a cross-sectional view of the floating parking barge of FIG. 1 taken along line 3-3 in FIG. 2.
Figure 4:
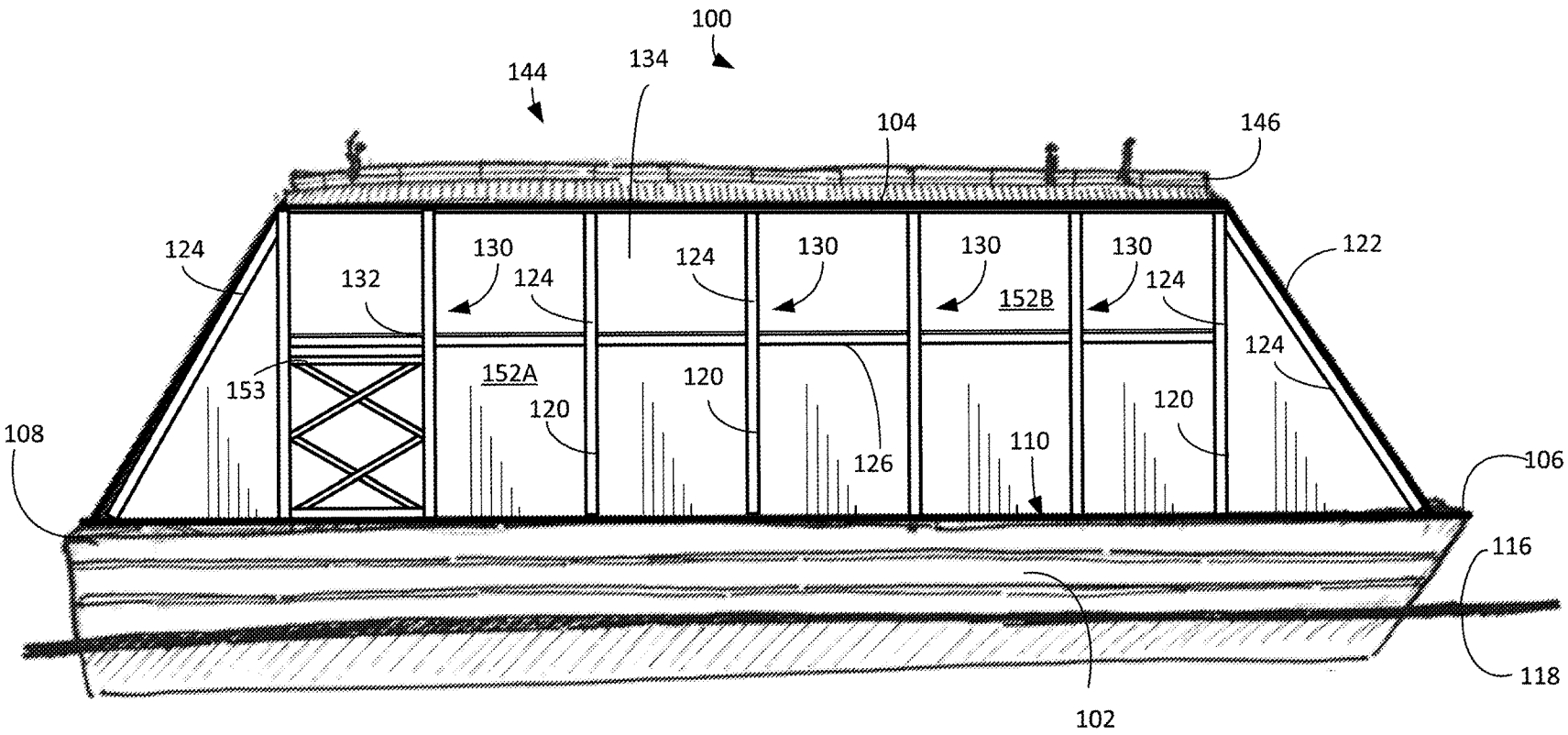
FIG. 4 is a cross-sectional view of the floating parking barge of FIG. 1 taken along line 4-4 in FIG. 1.

Referring to FIGS. 3 and 4, in certain aspects, the frame 120 is formed by a plurality of sections 130, each section extending substantially across the width direction of the parking barge 100 (i.e., the direction that is transverse to the length direction extending from the bow end 106 to the stern end 108). In various aspects, along a length of the parking barge 100 (e.g., from the stern end 108 to the bow end 106), a plurality of sections 130 may be provided. The sections 130 may be spaced at regular or irregular intervals along the length of the housing 104.

In some embodiments, a section 130 of the frame 120 includes a pair of side supports 124, a base support 126, and a top support 128. In addition to the side supports 124 of each section 130, additional side supports may be provided at the bow end 106, the stern end 108, and/or various other locations on the housing 104. The side supports 124, base support 126, and top support 128 may be various suitable structural materials including, but not limited to, various metals, timber, composites, plastics, various combinations thereof, or various other suitable materials. In certain cases, one or more of the side supports 124, base support 126, and/or top support 128 may be cellular to aid in controlling the total tonnage of the parking barge 100. Cellular side supports 124, base supports 126, and/or top supports 128 may further reduce top-heaviness of the parking barge 100 to further stabilize the parking barge 100. The cells formed by the side supports 124, base supports 126, and/or top supports 128 may also be configured to accommodate various utilities or services on the parking barge 100 (and optionally conceal them) including, but not limited to, electrical wiring, fiber-optic cables, pipes, conduits, etc. In the example of FIG. 3, the side supports 124 are cellular in that cells 155 are provided in the side supports 124. In some cases, each of the side supports 124 (and/or the base supports 126 and/or the top supports 128) may be formed of multiple support pieces that are attached together to form a side support 124 (or a base support 126 or top support 128). In such cases, some of the support pieces may be cellular and some of the support pieces may be solid. As one example, pieces of the side supports 124 forming a top level 152B may be cellular segments and pieces of the side supports 124 forming a bottom level 152A may be solid. Various other combinations of cellular and solid supports may be utilized.

While the side supports 124 can extend perpendicular to the support surface 110, in various examples and as illustrated in FIG. 3, the side supports 124 extend at a non-perpendicular angle 138 relative to the support surface 110 when the housing 104 and hull 102 are assembled. In some examples, the angle 138 is less than about 90°, such as about 50°, about 51°, about 52°, about 53°, about 54°, about 55°, about 56°, about 57°, about 58°, about 59°, about 60°, about 61°, about 62°, about 63°, about 64°, about 65°, about 66°, about 67°, about 68°, about 69°, about 70°, about 71°, about 72°, about 73°, about 74°, about 75°, about 76°, about 77°, about 78°, about 79°, about 80°, about 81°, about 82°, about 83°, about 84°, about 85°, about 86°, about 87°, about 88°, and/or about 89°. In other examples, the angle 138 may be less than 50° and/or greater than 90°. In some examples, the side supports 124 are angled such that, in a width direction (i.e., a direction that is transverse from the direction extending from the bow end to the stern end), a width of the housing 104 at a top end 140 is less than a width of the housing 104 at a bottom end 142. As one non-limiting example, the width of the housing 104 at the bottom end 142 may be about twice the width of the housing 104 at the top end 140, although it need not be in other examples. In certain cases, the side supports 124 are additionally or alternatively angled such that, in a length direction (i.e., the direction extending from the bow end to the stern end), a length of the housing 104 at the top end 140 is less than the length of the housing at the bottom end 142.

In various aspects, the base support 126 is joined to each side support 124 between a top end and a bottom end of each base support 126. In some examples, as illustrated in FIG. 3, covering material 132 is supported by the base support 126. The covering material 132 may be decking, sheets of material, or various other suitable materials for supporting a vehicle as described in detail below. The covering material 132 may span one or more sections 130 of the frame 120. In other examples, the base support 126 may span one or more sections 130 along the length of the parking barge 100 to provide the supporting surface for a vehicle. As such the number of base supports 126 may be the same or different from a number of pairs of side supports 124. Overall, the covering material 132 may form a substantially continuous surface supported by the base support 126 upon which cars and/or other vehicles may be parked In certain cases, as illustrated in FIGS. 3 and 4, the top support 128 of one or more sections 130 is cambered or arched to provide increased spacing between the base support 126 and the top support 128. In other examples, the top support 128 may have various other suitable shapes or profiles as desired. In certain aspects, the cambered top support 128 may provide increased durability to the parking barge 100 as discussed in greater detail below.

The cladding 122 is supported on the frame 120 and encloses the frame 120 such that the housing 104 defines a housing space 134. During use, vehicles are accommodated within the housing space 134. By enclosing the housing space 134, the cladding 122 protects vehicles within the housing space 134 from various conditions or hazards such as saltwater, various weather conditions, and/or various other external events that could otherwise damage the vehicles.

In certain cases, the cladding 122 may be supported on the frame 120 through various suitable mechanisms including, but not limited to, welding, riveting, bolts, screws, pins, hooks, or other suitable mechanisms. In some cases, the cladding 122 may be permanently supported on the frame 120 or may be removably supported on the frame 120.

The cladding 122 may be one or more sheets of durable material that are weather resistant, saltwater resistant, blast resistant, small arms resistant, various combinations thereof, and/or various other types of durable material. In some cases, the cladding 122 may be various materials including, but not limited to, various metals, various composites, various plastics, various combinations thereof, or various other suitable materials. In some cases, the cladding 122 is a material that is at least weather resistant.

As illustrated in FIGS. 1, 3, and 4, the cladding 122 on the side supports 124 of the frame 120 can be angled at a non-perpendicular angle relative to the support surface 110. In various examples, the angle 136 is the same as the angle 138, although it need not be. In certain examples, the angle 136 is less than about 90°, such as about 50°, about 51°, about 52°, about 53°, about 54°, about 55°, about 56°, about 57°, about 58°, about 59°, about 60°, about 61°, about 62°, about 63°, about 64°, about 65°, about 66°, about 67°, about 68°, about 69°, about 70°, about 71°, about 72°, about 73°, about 74°, about 75°, about 76°, about 77°, about 78°, about 79°, about 80°, about 81°, about 82°, about 83°, about 84°, about 85°, about 86°, about 87°, about 88°, and/or about 89°. By angling the cladding 122 at the angle 136, the parking barge 100 provides increased resistance to external factors that may be encountered such as high winds and debris in high winds, saltwater, etc. because the angle deflects the potential hazards away from and around the vehicles in the housing space 134 (see arrows 154 in FIG. 2). Optionally, where the top support 128 is cambered, the cladding 122 covering the top support 128 may also be arcuate-shaped to provide additional weather resistance or durability to the parking barge 100.

As best illustrated in FIGS. 1 and 4, in some optional examples, the cladding 122 defines an observation deck 144 at the top end 140 of the housing 104. The observation deck 144 may include various safety features such as railings 146, surface coverings, etc. Access to the observation deck 144 may be provided through the housing space 134 through stairs, lifts, etc.

In various examples, the cladding 122 defines one or more access openings that accommodate vehicles such that the vehicles may enter into or exit from the housing space 134. One or more of the access openings may include a retractable door 148. The retractable door 148 is movable between a stowed position, in which access to the access opening is prevented, and a deployed position, in which access through the access opening is permitted. In some optional examples, in the deployed position, the retractable door 148 may define a vehicle ramp providing access to the access opening. In other examples, a mount 150 may be provided on the cladding 122 for supporting the retractable door 148. As one non-limiting example, the door 148 may be various roll-up doors, pivotable doors, sliding doors, or other suitable retractable doors, and the mount 150 may be various suitable supporting brackets, rails, or other suitable supporting devices. The mount 150 and/or retractable door 148 may be omitted if desired in some examples.

Referring to FIGS. 3 and 4, in various examples, the housing space 134 may be subdivided into at least two parking levels 152A-B, although any number of parking levels 152 may be provided in other examples. In certain aspects, the first parking level 152A is the portion of the housing space 134 between the support surface 110 and the base support 126, and the second parking level 152B is the portion of the housing space 134 between the base support 126 and the top support 128. During use, vehicles may be positioned on the support surface 110 (or any other surface) in the first parking level 152A and on the covering material 132 and/or base support 126 in the second parking level 152B. The first parking level 152A is connected to the second parking level 152B through a connecting device 153. In various aspects, the connecting device 153 is a suitable mechanism for allowing movement between the parking levels 152A-B including, but not limited to, a ramp, a hydraulic lift and platform, etc. In certain cases, the connecting device is provided within the housing space 134 such that vehicles remain protected while traveling between the levels. In the example illustrated in FIG. 4, the connecting device 153 is a hydraulic lift and platform.

In some cases, a height 156 of the first parking level 152A (or a distance from the support surface 110 to the base support 126) is different from a height 158 of the second parking level 152B (or a distance from the base support 126 to the top support 128). As one example, the height 156 of the first parking level 152A is greater than the height 158 of the second parking level 152B. In such examples, the differing heights of the parking levels provide increased stability to the parking barge 100 by restricting or limiting the types of vehicles that are accommodated on each level. In other optional examples, the heights of the parking levels may be about the same.

As mentioned previously, the housing 104 and hull 102 may be modular such that the housing 104 and hull 102 may be pre-assembled before being joined to form the parking barge 100. In some examples, a method of fabricating the parking barge 100 includes pre-assembling the housing 104 by joining the side supports 124 of the frame 120 with the base support 126 and/or the top support 128 of the frame 120. The method also includes securing the cladding 122 to a frame 120 such that the cladding 122 encloses the frame 120 and defines the housing space 134 for the housing 104. The method includes providing the hull 102 with the bow end 106, stern end 108, and support surface 110. In various aspects, the method includes mounting the housing 104 on the support surface 110 of the hull 102 such that the side supports 124 of the frame 120 and the cladding 122 both extend at an angle less than 90 degrees relative to the support surface 110.

Through the housing 104 and the hull 102, the parking barge 100 provides a mobile structure that can be positioned as desired on any body of water to provide additional space for vehicles. The parking barge 100 provides a protected environment for vehicles through the enclosed housing space 134 that directly protects vehicles from external factors and the angled cladding that further reduces the impact or effect of external factors such as wind, debris, saltwater, etc. on the parking barge 100 and the vehicles within the parking barge 100. The parking barge 100 may further provide increased stability and minimize or reduce rocking or capsizing when the spuds 114 are anchored. In addition to providing flexible parking locations, the parking barge 100 may also be used for disaster relief assistance (e.g., by providing a protected structure for transporting aid/vehicles as well as a protected working space upon arrival), emergency situations, or etc. In some cases, the parking barge 100 may be used as a long-term construction platform. For example, the surface on the top end 140 may accommodate equipment and/or personnel working under a bridge, for example, and amenities, tools, and/or equipment may be stored in the housing space.

A collection of exemplary embodiments, including at least some explicitly enumerated as "ECs" (Example Combinations), providing additional description of a variety of embodiment types in accordance with the concepts described herein are provided below. These examples are not meant to be mutually exclusive, exhaustive, or restrictive; and the invention is not limited to these example embodiments but rather encompasses all possible modifications and variations within the scope of the issued claims and their equivalents.

EC 1. A floating parking barge comprising: a floatable hull comprising a bow end, a stern end, and a support surface extending from the bow end to the stern end; and a housing mounted on the support surface, the housing comprising a frame and cladding, wherein the frame comprises side supports and top supports, wherein the cladding is supported on the frame and encloses the frame such that the housing defines a housing space configured to accommodate a plurality of vehicles, and wherein the cladding covering the side supports extends at an angle relative to the support surface that is less than 90 degrees.

EC 2. The floating parking barge of any of the preceding or subsequent example combinations, wherein the angle of the cladding is from about 60 degrees to about 85 degrees.

EC 3. The floating parking barge of any of the preceding or subsequent example combinations, wherein the angle of the cladding is from about 70 degrees to about 80 degrees.

EC 4. The floating parking barge of any of the preceding or subsequent example combinations, wherein the angle is of the cladding is about 75 degrees.

EC 5. The floating parking barge of any of the preceding or subsequent example combinations, wherein the side supports extend at an angle relative to the support surface that is less than 90 degrees.

EC 6. The floating parking barge of any of the preceding or subsequent example combinations, wherein the angle of the side supports is the same as the angle of the cladding.

EC 7. The floating parking barge of any of the preceding or subsequent example combinations, wherein the housing comprises a bow end, a stern end, a top end, and a bottom end, and wherein a length of the housing at the top end is less than a length of the housing at the bottom end.

EC 8. The floating parking barge of any of the preceding or subsequent example combinations, wherein a width of the housing at the top end is less than a width of the housing at the bottom end.

EC 9. The floating parking barge of any of the preceding or subsequent example combinations, wherein the width of the housing at the bottom end is at least twice the width of the housing at the top end.

EC 10. The floating parking barge of any of the preceding or subsequent example combinations, wherein the frame further comprises a base support supported by side supports between the top supports and the support surface, and wherein the base support defines a first housing portion of the housing space between the base support and the support surface and a second housing portion of the housing space between the base support and the top supports.

EC 11. The floating parking barge of any of the preceding or subsequent example combinations, wherein a height of the first housing portion is greater than a height of the second housing portion.

EC 12. The floating parking barge of any of the preceding or subsequent example combinations, further comprising a connecting device within the housing space and connecting the support surface with the base support.

EC 13. The floating parking barge of any of the preceding or subsequent example combinations, wherein the connecting device comprises a ramp.

EC 14. The floating parking barge of any of the preceding or subsequent example combinations, wherein the connecting device comprises a platform movably supported by a hydraulic lift.

EC 15. The floating parking barge of any of the preceding or subsequent example combinations, wherein the side supports comprise cellular beams.

EC 16. The floating parking barge of any of the preceding or subsequent example combinations, wherein the hull comprises a plurality of spuds, and wherein the floating parking barge is anchorable through the plurality of spuds.

EC 17. The floating parking barge of any of the preceding or subsequent example combinations, wherein the cladding is saltwater-resistant.

EC 18. The floating parking barge of any of the preceding or subsequent example combinations, wherein the cladding is small arms resistant or blast resistant.

EC 19. The floating parking barge of any of the preceding or subsequent example combinations, wherein the cladding further defines at least one access opening dimensioned to accommodate a vehicle through the cladding and into the housing space, and wherein the housing further comprises at least one retractable door that is positionable between a deployed position and a stowed position such that the at least one retractable door selectively provides access to the access opening.

EC 20. The floating parking barge of any of the preceding or subsequent example combinations, wherein the retractable door is pivotable relative to the hull and the housing such that in a deployed position, the retractable door defines a ramp providing an access surface to the access opening.

EC 21. A method of fabricating a parking barge comprising: pre-assembling a housing by: joining side supports of a frame with a base support of the frame; and securing cladding to a frame such that the cladding encloses the frame and defines a housing space for the housing; providing a hull comprising a bow end, a stern end, and a support surface extending from the bow end to the stern end; and mounting the housing on the support surface of the hull such that the side supports of the frame and the cladding both extend at an angle less than 90 degrees relative to the support surface.

EC 22. The method of any of the preceding or subsequent example combinations, wherein the angle of the cladding is from about 60 degrees to about 85 degrees.

EC 23. The method of any of the preceding or subsequent example combinations, wherein the angle of the cladding is from about 70 degrees to about 80 degrees.

EC 24. The method of any of the preceding or subsequent example combinations, wherein the angle is of the cladding is about 75 degrees.

EC 25. The method of any of the preceding or subsequent example combinations, wherein each of the side supports of the frame comprises a top end and a bottom end, and wherein joining the side supports with the base support comprises joining the base support to the side supports such that a distance from the base support to the top end is less than a distance from the base support to the bottom end of each side support.

The above-described aspects are merely possible examples of implementations, merely set forth for a clear understanding of the principles of the present disclosure. Many variations and modifications can be made to the above-described embodiment(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims that follow, they are used only in a generic and descriptive sense, and not for the purposes of limiting the described invention, nor the claims that follow.

That which is claimed:

1. A floating parking barge comprising:

a floatable hull comprising a bow end, a stern end, and a support surface extending from the bow end to the stern end;

a housing mounted n the support surface, the housing comprising a frame and cladding, wherein the frame comprises side supports and top supports, wherein the cladding is supported on the frame and encloses the frame such that the housing defines a housing space configured to accommodate a plurality of vehicles, wherein the cladding covering the side supports extends at an angle relative to the support surface that is less than 90 degrees, wherein the frame further comprises a base support supported by side supports between the top supports and the support surface, wherein the base support defines a first housing portion of the housing space between the base support and the support surface and a second housing portion of the housing space between the base support and the top supports, wherein the floating parking barge further comprises a connecting device within the housing space and connecting the support surface with the base support, and wherein the connecting device comprises a ramp.

2. The floating parking barge of claim 1, wherein the angle of the cladding is from about 60 degrees to about 85 degrees.

3. The floating parking barge of claim 2, wherein the angle of the cladding is from about 70 degrees to about 80 degrees.

4. The floating parking barge of claim 3, wherein the angle is of the cladding is about 75 degrees.

5. The floating parking barge of claim 1, wherein the side supports extend at an angle relative to the support surface that is less than 90 degrees.

6. Tae floating parking barge of claim 5, wherein the angle of the side supports is the same as the angle of the cladding.

7. The floating parking barge of claim 1, wherein the housing comprises a bow end, a stern end, a top end, and a bottom end, and wherein a length of the housing at the top end is less than a length of the housing at the bottom end.

8. The floating parking barge of claim 7, wherein a width of the housing at the top end is less than a width of the housing at the bottom end.

9. The floating parking barge of claim 8, wherein the width of the housing at the bottom end is at least twice the width of the housing at the top end.

10. The floating parking barge of claim 1, wherein a height of the first housing portion is greater than a height of the second housing portion.

11. The floating parking barge of claim 1, wherein the side supports comprise beams, and wherein each beam comprises a plurality of apertures extending through the beam.

12. The floating parking barge of claim 1, wherein the hull comprises a plurality of spuds, and wherein the floating parking barge is anchorable through the plurality of spuds.

13. The floating parking barge of claim 1, wherein the cladding further defines at least one access opening dimensioned to accommodate a vehicle through the cladding and into the housing space, and wherein the housing further comprises at least one retractable door that is positionable between a deployed position and a stowed position such that the at least one retractable door selectively provides access to the access opening.

14. A floating parking barge comprising:

a floatable hull comprising a bow end, a stern end, and a support surface extending from the bow end to the stern end; and a housing mounted on the support surface, housing comprising a frame and cladding, wherein the frame comprises side supports and top supports, wherein the cladding is supported on the frame and encloses the frame such that the housing defines a housing space configured to accommodate a plurality of vehicles, wherein the cladding covering the side supports extends at an angle relative to the support surface that is less than 90 degrees, wherein the frame further comprises a base support supported by side supports between the top supports and the support surface, wherein the base support defines a first housing portion of the housing space between the base support and the support surface and a second housing portion of the housing space between the base support and the top supports, wherein the floating parking barge further comprises a connecting device within the housing space and connecting the support surface with the base support, and wherein the connecting device comprises a platform movably supported by a hydraulic lift.

* * * * *